US006120018A

United States Patent [19]

Amano

[11] Patent Number: 6,120,018

[45] Date of Patent: Sep. 19, 2000

[54] SHEET FEEDING APPARATUS

[75] Inventor: Masao Amano, Susono, Japan

[73] Assignee: Canon Kabushiki Kaisha, Tokyo, Japan

[21] Appl. No.: 09/340,135

[22] Filed: Jun. 28, 1999

[51] Int. Cl.[7] ..... B65H 3/52

[52] U.S. Cl. ..... 271/121; 271/122; 271/125

[58] Field of Search ..... 271/121, 122, 271/125

[56] References Cited

U.S. PATENT DOCUMENTS

| | | | |
|---|---|---|---|
| 4,627,607 | 12/1986 | Ishii | 271/122 |
| 5,050,854 | 9/1991 | Tojima | 271/122 |
| 5,172,899 | 12/1992 | Tajima | 271/125 X |
| 5,944,305 | 8/1999 | Takashima et al. | 271/127 |

*Primary Examiner*—David H. Bollinger

*Attorney, Agent, or Firm*—Fitzpatrick, Cella, Harper & Scinto

[57] ABSTRACT

The present invention provides a sheet feeding apparatus comprising a pair of rotary drive shafts disposed in parallel with each other and rotated in the same direction, a sheet feed roller provided on one of the rotary drive shafts, and a reverse rotation roller provided on the other rotary drive shaft and urged against the sheet feed roller, and wherein sheets are separated and fed one by one between the sheet feed roller and the reverse rotation roller, and further wherein at least one of the sheet feed roller and the reverse rotation roller is provided with a through hole through which the rotary drive shaft passes, and the through hole has an intermediate portion through which the rotary drive shaft passes, and an escape portion provided at an end and adapted to permit inclination of the rotary drive shaft to maintain parallelism between one roller and the other roller if the rotary drive shaft is inclined.

11 Claims, 8 Drawing Sheets

SHEET FEEDING APPARATUS

BACKGROUND OF THE INVENTION

1. Field of the Invention

The present invention relates to a sheet feeding apparatus for feeding a sheet, and an image forming apparatus such as a copying machine, a facsimile, a printer and the like, having such a sheet feeding apparatus and adapted to form an image on the sheet fed from the sheet feeding apparatus.

2. Related Background Art

In the past, sheet feeding apparatuses adopted various sheet feeding systems and sheet separating systems. As an example of the sheet separating systems, there is a retard separating system.

Now, a construction and an operation of a sheet feeding apparatus 29 having the retard separating system will be briefly described with reference to FIG. 8.

When a single sheet is fed between a feed roller 8 and a retard roller 9 which are urged against each other, the feed roller 8 is rotated together with a rotary drive shaft 21 in a direction shown by the arrow A. The retard roller 9 is rotatingly driven by rotation of the feed roller 8 via the sheet in a direction shown by the arrow C opposite to a rotational direction B of a rotating rotary drive shaft 24. The both rollers 8, 9 constitute a pair of separation rollers.

The reason that the retard roller 9 provided on the rotary drive shaft 24 rotated in the direction B can be rotatingly driven by the rotation of the feed roller 8 in the direction opposite to the rotational direction of the rotary drive shaft 24 is presence of a torque limiter 25 disposed between the retard roller 9 and the rotary drive shaft 24 so that reverse rotation of the retard roller is allowed by the torque limiter 25.

If a plurality of sheets are double-fed, a frictional force of the torque limiter overcomes a frictional force between the sheets, so that the retard roller 9 is rotated in the direction B.

Thus, only the sheet contacted with the feed roller 8 is fed, and the other sheets are not fed by the retard roller 9, thereby separating the other from the fed sheet.

In this way, since the sheet feeding apparatus 29 having the retard separating system can separate the sheet positively, it has high reliability and has been widely used.

However, in the sheet feeding apparatus 29, a sheet separating ability may be worsened and/or sheet jam may occur due to wear and/or deformation of rubber portions 8*a*, 9*a* of the pair of separation rollers 8, 9. Thus, the pair of separation rollers 8, 9 must be designed so that they can easily be replaced by new ones by an end user.

To this end, the pair of separation rollers 8, 9 are designed so that they are detachably mounted on one ends of the rotary drive shafts 21, 24 protruded from a support 20 and an arm 18 to be able to be detached by a one-touch operation, thereby facilitating the replacement of the rollers. That is to say, although the feed roller 8 and the retard roller 9 are normally prevented from disengaging from the rotary drive shafts 21, 24 by engagement between circumferential engagement grooves 4, 5 formed in one ends of the rotary drive shafts 21, 24 and engagement projections 8*d*, 9*d* provided on the feed roller 8 and the retard roller 9, by disengaging the engagement projections 8*d*, 9*d* from the engagement grooves 4, 5, the rollers 8, 9 can easily be removed from the rotary drive shafts 21, 24.

However, in the above-mentioned sheet feeding apparatus 29, if tolerances of parts are added or accumulated or if any part is worn due to long term use, as shown in FIG. 9, the rotary drive shafts 21, 24 may be inclined to offset the retard roller 9 from the feed roller 8.

Further, since the pair of separation rollers 8, 9 are provided on the ends of the rotary drive shafts 21, 24, the rotary drive shafts 21, 24 are flexed more or less, with the result that the retard roller 9 may be offset from the feed roller 8.

Incidentally, in FIG. 9, although it is exaggerated so that a gap between the rollers 8 and 9 is not uniform completely from left to right, actually, any gap is not generated due to elasticity of the rubber portions 8*a*, 9*a*, but, it generally seems as if the rollers are uniformly contacted along the entire length thereof. Acordingly, even when it seems that there is no gap between the rollers 8 and 9, an urging force between the rollers 8, 9 is not always uniform.

If the rollers 8, 9 are offset from each other, the rubber portions 8*a*, 9*a* of the rollers 8, 9 will be worn eccentrically to generate a thrust load directing toward a left-and-right direction in FIG. 9, thereby increasing load torque, with the result that the rotary drive shafts 21, 24 cannot be rotated smoothly.

As a result, the sheet separating ability of the sheet feeding apparatus 29 is worsened. Further, if the rubber portions 8*a*, 9*a* of the rollers 8, 9 are worn eccentrically, service lives of the rollers will be shortened, with the result that the rollers 8, 9 must be replaced frequently.

Therefore, it is important that parallelism between the feed roller 8 and the retard roller 9 be maintained or ensured, and, there is a need for providing substantially uniform urging load (radial load) between the rollers through the entire length thereof.

Further, in an image forming apparatus having such a sheet feeding apparatus for feeding a sheet in this way, since the sheet cannot be fed positively and correctly, an image cannot be formed on the sheet correctly.

SUMMARY OF THE INVENTION

An object of the present invention is to provide a sheet feeding apparatus in which a uniform radial load can be generated through an entire length, even in consideration of tolerance of parts, without increasing cost, while maintaining easy replacement of a sheet feed roller and a retard (reverse rotation) roller, and an image forming apparatus having such a sheet feeding apparatus.

To achieve the above object, the present invention provides a sheet feeding apparatus comprising a pair of rotary drive shafts disposed in parallel with each other and rotated in the same direction, a sheet feed roller provided on one of the rotary drive shafts, and a reverse rotation roller provided on the other rotary drive shaft and urged against the sheet feed roller, and wherein sheets are separated and fed one by one between the sheet feed roller and the reverse rotation roller, and further wherein at least one of the sheet feed roller and the reverse rotation roller is provided with a through hole through which the rotary drive shaft passes, and the through hole has an intermediate portion through which the rotary drive shaft passes, and an escape portion provided at an end and adapted to permit inclination of the rotary drive shaft to maintain parallelism between one roller and the other roller if the rotary drive shaft is inclined.

DESCRIPTION OF THE PREFERRED EMBODIMENTS

Figure 1:
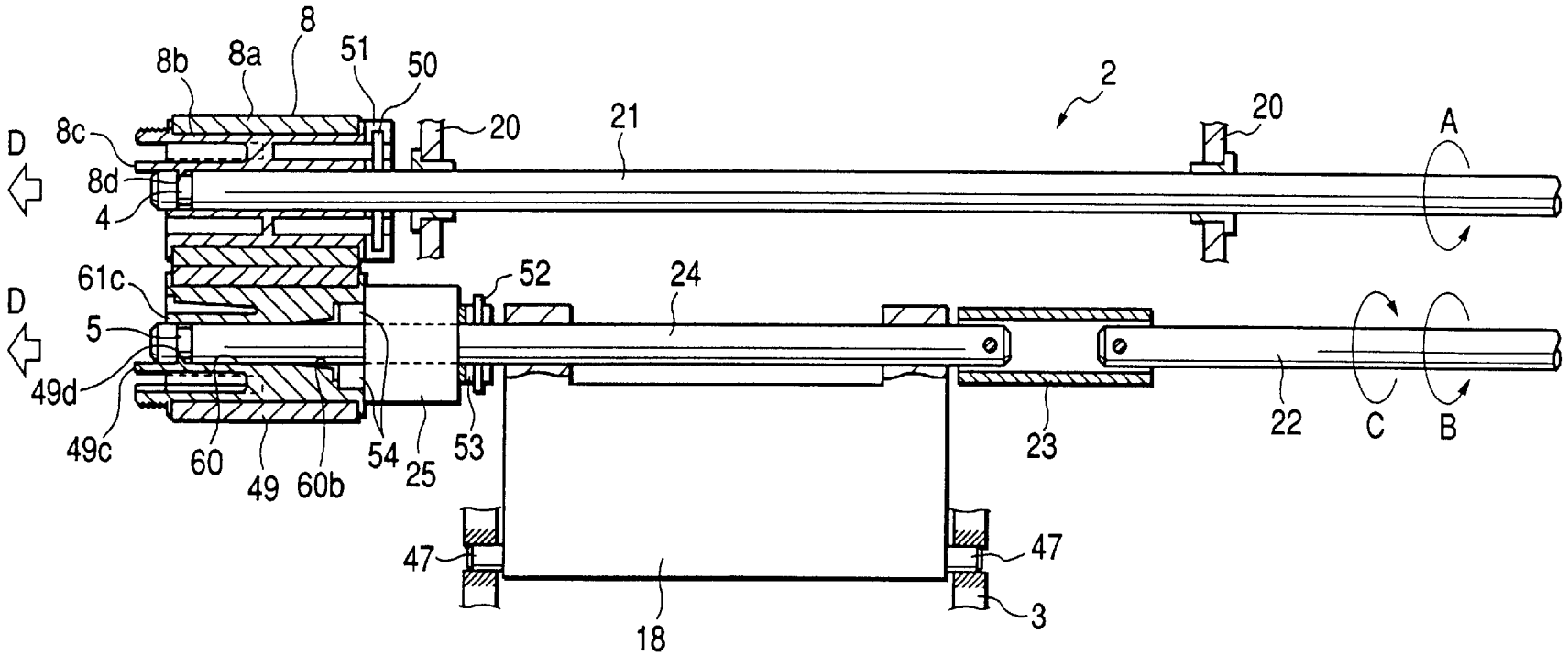
FIG. 1 is sectional view of a sheet feeding apparatus according to an embodiment of the present invention, taken along a rotary drive shaft.

The present invention will now be explained in connection with an embodiment thereof with reference to FIGS. 1 to 7.

Incidentally, the same elements as those of the conventional ones are designated by the same reference numerals. Further, in the drawings, directions shown by the arrows A, C are normal rotation directions along which a sheet is conveyed, and a direction shown by the arrow B is a reverse rotation direction along which the sheet is conveyed reversely.

Figure 6:
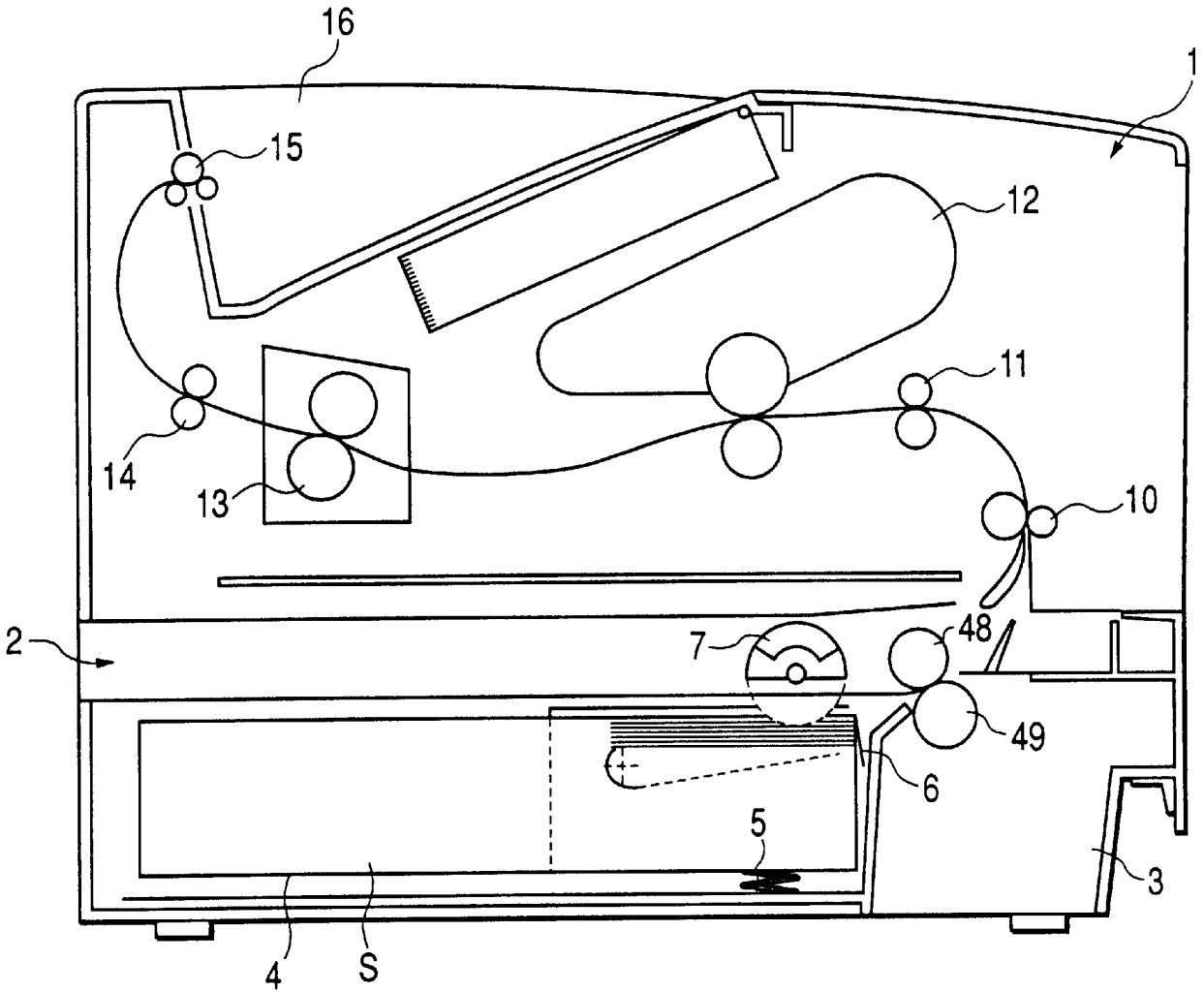
FIG. 6 is a schematic front sectional view of an image forming apparatus having the sheet feeding apparatus according to the embodiment of the present invention.
Figure 7:
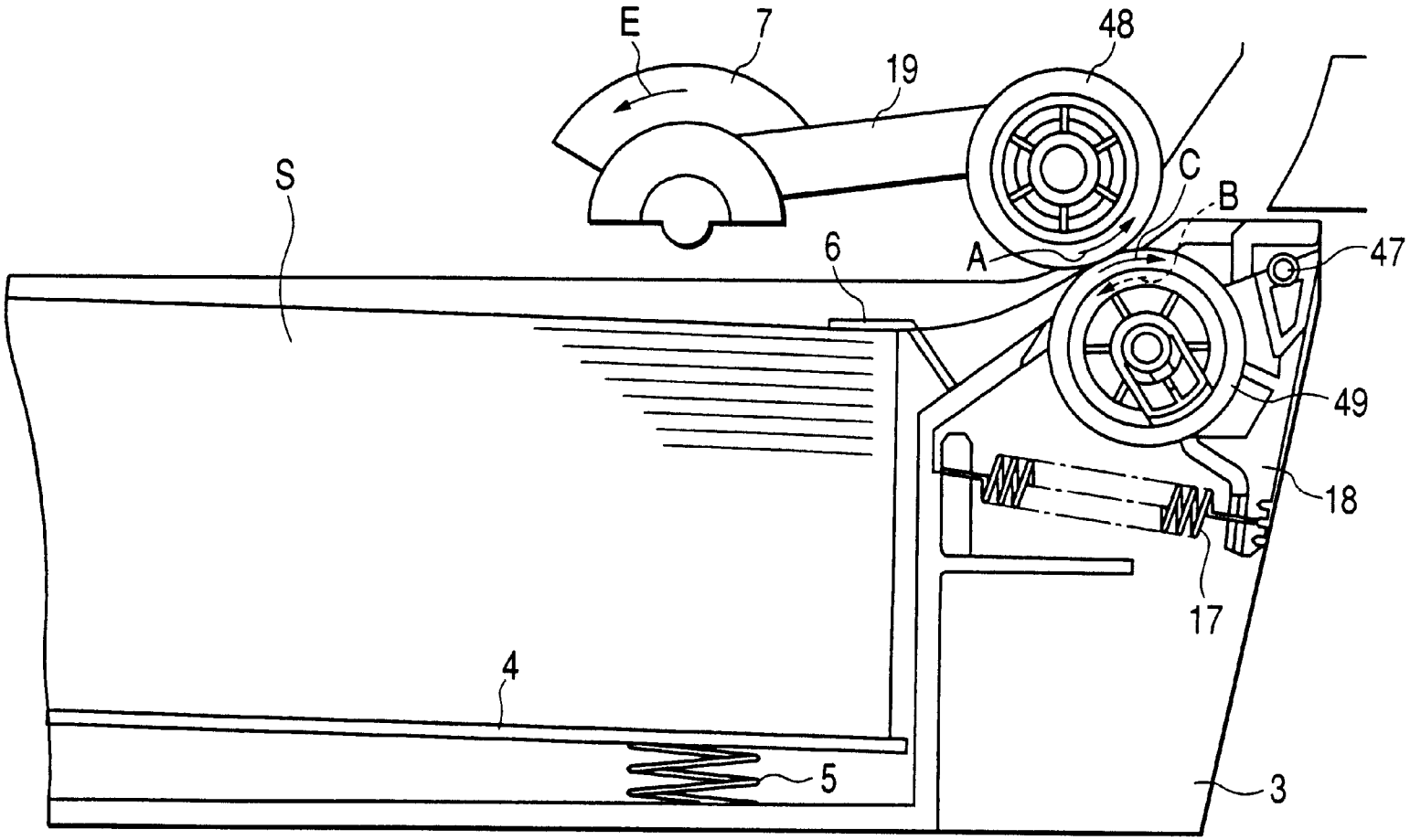
FIG. 7 is a schematic enlarged view of the sheet feeding apparatus of FIG. 6.
Figure 8:
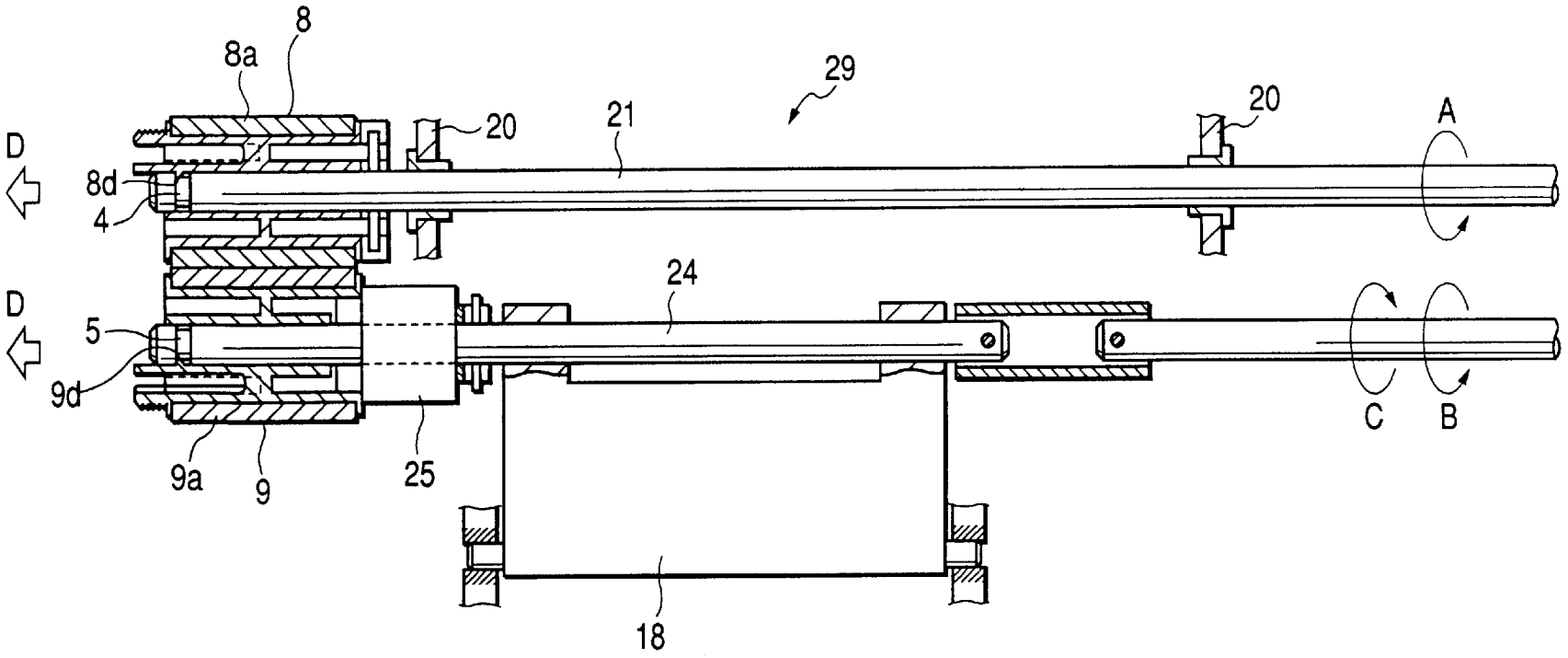
FIG. 8 is a sectional view of a conventional sheet feeding apparatus, taken along a rotary drive shaft.
Figure 9:
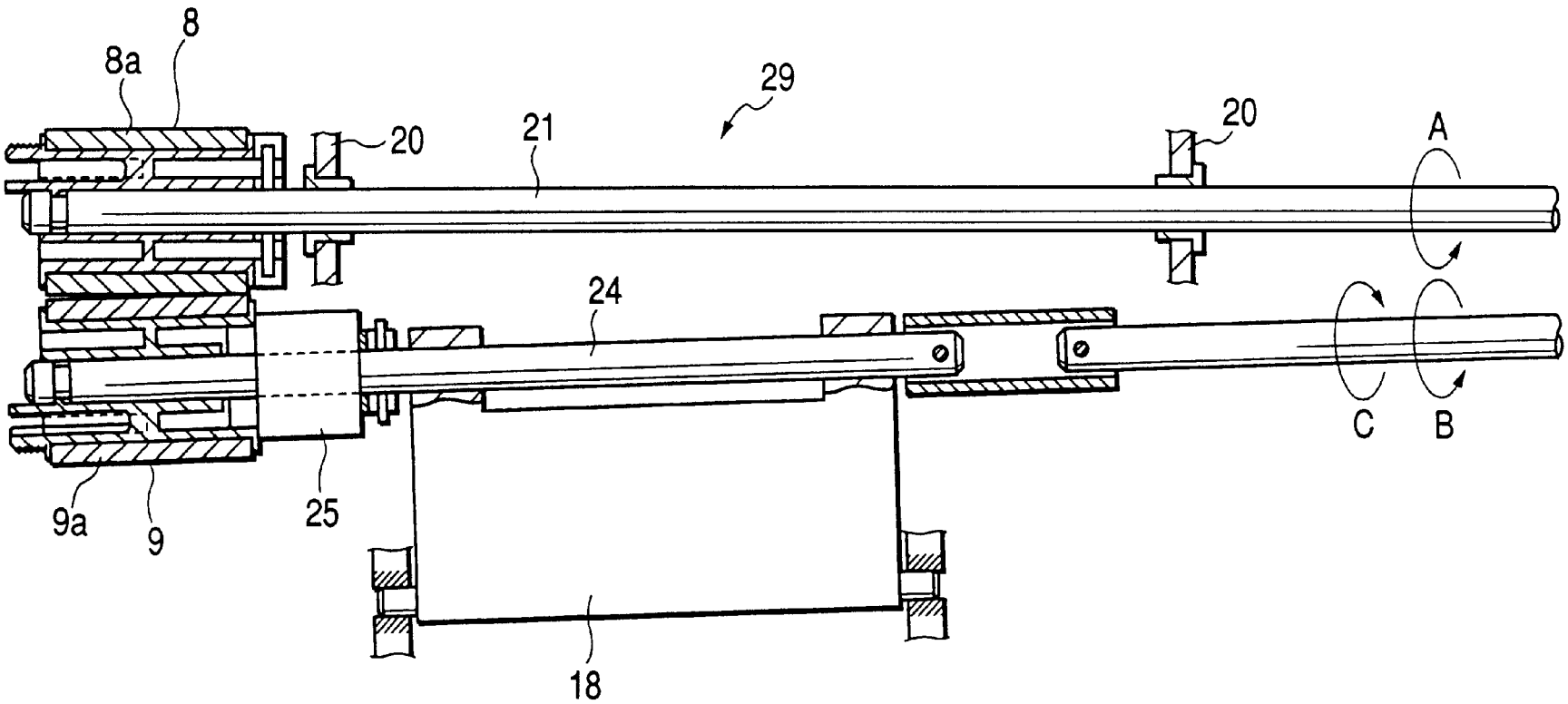
FIG. 9 is a view for explaining an operation of the conventional sheet feeding apparatus.

In FIGS. 6 and 7, a sheet feeding apparatus 2 is incorporated into a lower part of an image forming apparatus 1. A sheet containing cassette 3 of the sheet feeding apparatus 2 includes an intermediate plate 4 on which sheets S are directly stacked, a spring 5 for urging the sheet S against a pick-up roller 7 in opposition to the weight of the sheets S, and a sheet urging means 6 for regulating rotation of the sheet stack S around a fulcrum by a biasing force of the spring 5. The sheet urging means 6 is constituted by a so-alled separation claw having a function for separating the sheets.

When an image forming signal is outputted from a controller unit (not shown), the pick-up roller 7 is rotated in a direction shown by the arrow E to pick up an uppermost sheet. Substantially at the same time, a feed roller (sheet feed roller) 8 is rotated in a sheet conveying direction (shown by the arrow A). Further, a retard roller (reverse rotation roller) 49 which forms a pair with the feed roller 8 is rotatingly driven in a direction shown by the arrow C by rotation of the feed roller 8.

The retard roller 49 is supported by an arm 18 (see FIG. 7) for rotation and is urged against the feed roller 8 with constant urging pressure. Incidentally, the feed roller 8 and the retard roller 49 constitute a pair of separation rollers. The arm 18 is supported inclinably by the sheet containing cassette 3 via a protruded shaft 47.

The retard roller 49 is rotated in a normal direction (sheet conveying direction of the feed roller 8) till the sheet reaches a nip of the pair of separation rollerst, 49. When only a single sheet is picked up, the retard roller is still rotated in the normal direction. However, if two or more sheets are picked up, the retard roller serves to return the sheets other than the uppermost sheet in a direction opposite to the sheet conveying direction, thereby preventing so-called double-feeding.

The feed roller 8 is rotated by a predetermined amount, and, at least when the sheet S reaches a convey roller 10, drive is interrupted to stop the feed roller. The sheet S is conveyed, through the convey rollers 10, 11, to an image forming portion 12, where an image is formed on the sheet. Then, in a fixing device 13, the image is fixed to the sheet. Thereafter, the sheet is conveyed by sheet discharge rollers 14, 15 and is discharged onto a sheet discharging and stacking portion 16.

In FIG. 1, the feed roller 8 is rotated integrally with a rotary drive shaft 21 rotatably supported by a frame 20 by engagement between a pin 50 formed on the rotary drive shaft 21 and a cut portion 51 formed in the feed roller 8.

Figure 4:
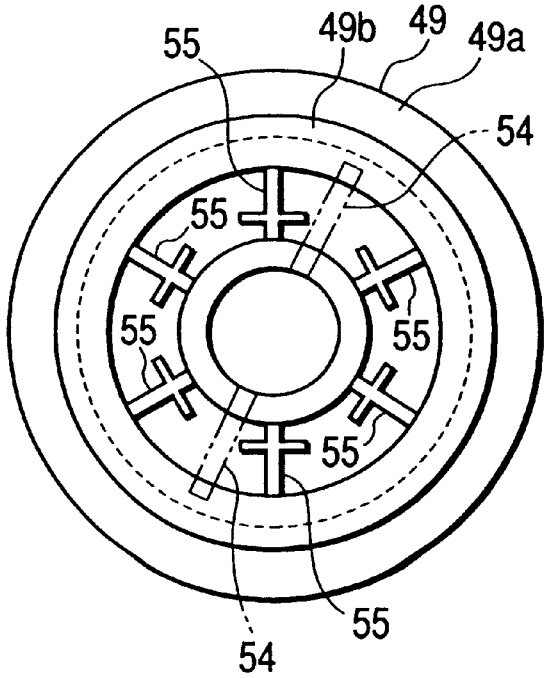
FIG. 4 is a right side view of the retard roller of FIG. 2.

The retard roller 49 receives a rotational force directing toward a direction shown by the arrow B from a rotary drive shaft 22 rotated in the direction (same as the rotational direction of the rotary drive shaft 21) through a coupling 23, a rotary drive shaft 24 rotatably supported by the arm 18 and a torque limiter 25. The rotary drive shaft 24 and the torque limiter 25 are rotated integrally with each other by engagement between a pin 52 formed on the rotary drive shaft and a cut portion 53 formed in the torque limiter 25. As shown in FIGS. 1 and 4, the torque limiter 25 and retard roller 49 are rotated integrally with each other by engagement of a pair of protruded pieces 54 between ribs 55 formed on one end of the retard roller 49.

The feed roller 8 and the retard roller 49 have cylindrical rubber portions 8*a*, 49*a* and cylindrical collar portions 8*b*, 49*b*, respectively, and the collar portions 8*b*, 49*b* are press-fit into the rubber portions 8*a*, 49*a*. The collar portions 8*b*, 49*b* are molded from resin and have pawl portions 8*c*, 49*c* having elasticity and are prevented from being dislodged in a thrust direction with respect to the rotary drive shafts 21, 24 by engaging engagement projections 8*d*, 49*d* of the pawl portions 8*c*, 49*c* with the grooves 4, 5 of the rotary drive shafts 21, 24. Accordingly, if the sheet separating ability of the feed roller 8 and the retard roller 49 is decreased due to expiration of their service lives, by disengaging the engagement projections 8*d*, 49*d* from the grooves 4, 5 by flexing the pawl portions 8*c*, 49*c*, the feed roller 8 and the retard roller 49 can easily be removed along the direction D.

Figure 2:
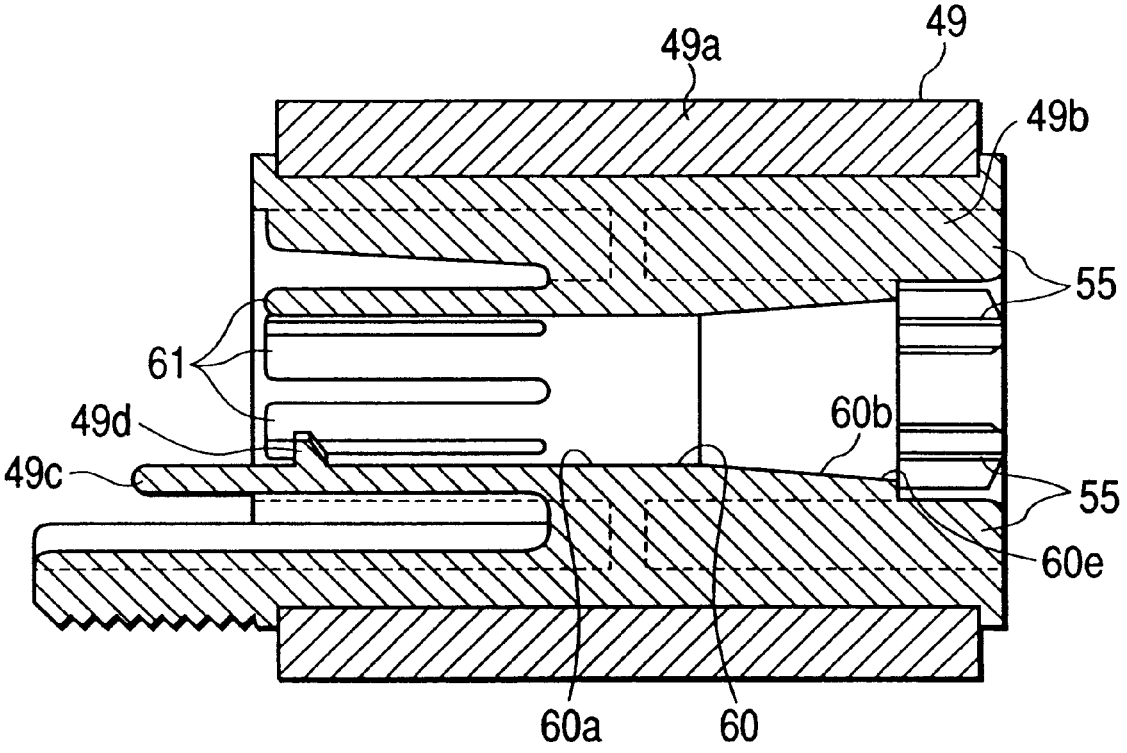
FIG. 2 is a retard roller according to an embodiment of the present invention, taken along a rotary drive shaft passing through hole of the retard roller.
Figure 3:
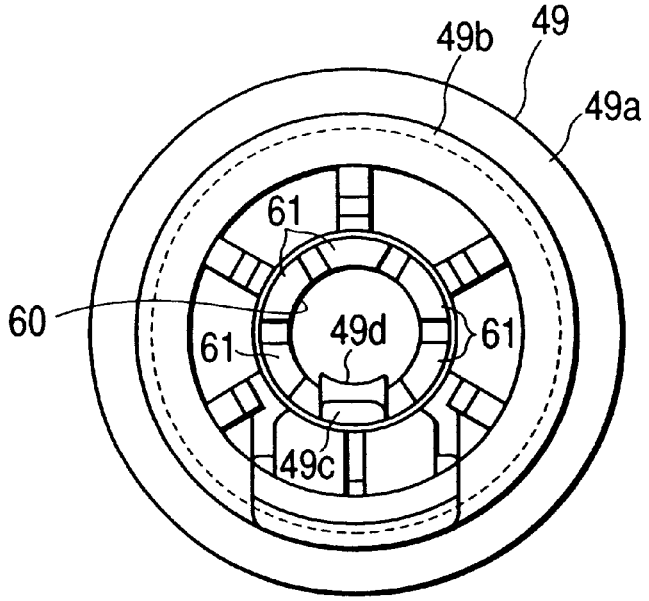
FIG. 3 is a left side view of the retard roller of FIG. 2.

In FIG. 2, an intermediate portion 60*a* of a rotary drive shaft passing through hole 60 of the retard roller 49 has a substantially straight shape. The intermediate portion 60*a* is a main portion for positioning the retard roller 49 with respect to the rotary drive shaft 24 and for supporting load.

At the right of the intermediate portion 60*a*, an enlarged diameter portion 60*b* spreading in a cone fashion from the intermediate portion toward an end portion 60*e* is formed. That is to say, the enlarged diameter portion 60*b* has a small diameter near the intermediate portion 60*a* and a large diameter near the end portion 60*e*.

A portion at the left of the intermediate portion 60*a* extends in the thrust direction and is provided with a plurality of elastic pieces 61 arranged in a circumferential direction. Incidentally, the pawl portion 49*c* is formed on one of the elastic pieces 61.

Figure 5:
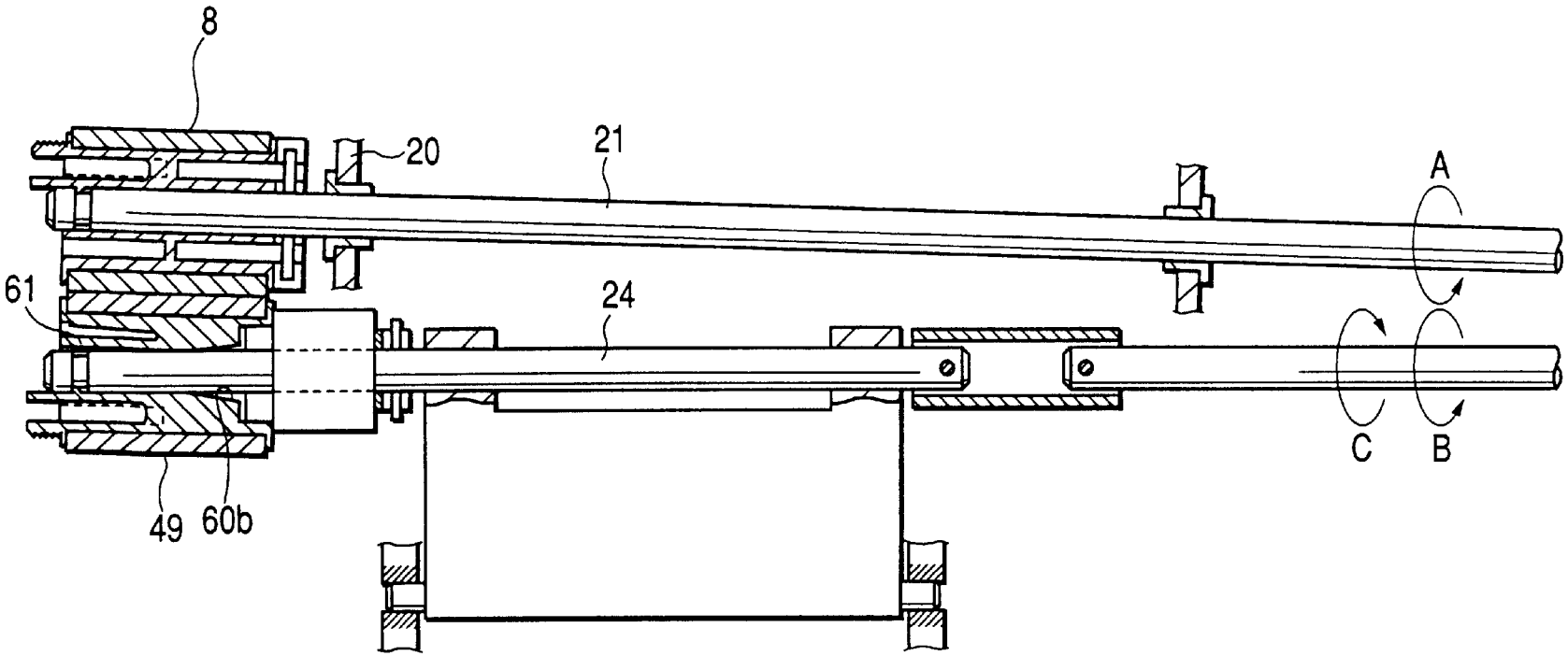
FIG. 5 is a view for explaining an operation of the sheet feeding apparatus.

As shown in FIG. 5, due to total tolerance and time-lapse deformation of various parts, if the rotary drive shafts 21, 24 are inclined, the feed roller 8 on the rotary drive shaft 21 is also inclined together with the rotary drive shaft 21. The retard roller 49 on the rotary drive shaft 24 also tends to be inclined together with the rotary drive shaft 24. However, since the enlarged diameter portion 60*b* and the elastic pieces 61 are formed on the retard roller 49, the retard roller 49 is inclined to follow the inclination of the feed roller 8 while being urged against the feed roller 8, and the rotary drive shaft 24 is inclined independently from the retard roller 49.

Further, as shown in FIGS. 1 and 4, since the pair of protruded pieces 54 are merely entered into and engaged between the ribs 55 formed on one end of the retard roller 49, the retard roller 49 can easily be inclined with respect to the torque limiter 25.

As a result, the feed roller 8 and the retard roller 49 are urged against each other through the entire length thereof and are not offset from each other.

In this way, the pair of separation rollers 8, 49 automatically maintain the parallelism condition, with the result that the rollers are urged against each other substantially uniformly in the roller nip, thereby increasing the service lives of the rollers and preventing reduction of the sheet separating ability for a long term.

Further, since the pair of separation rollers 8, 49 are provided on the ends of the rotary drive shafts 21, 24, even if the rotary drive shafts 21, 24 are flexed more or less, similarly, the retard roller 49 is not offset from the feed roller 8.

Incidentally, since the collar portion 49*b* is the integrally molded part, in consideration of the pawl portion 49*c*, although the enlarged diameter portion 60*b* is formed only at the right side, in place of the elastic pieces 61, an additional enlarged diameter portion may also be formed at the left side. Further, although the elastic pieces 61 are formed only at the left side, in place of the enlarged diameter portion 60*b*, additional elastic pieces may be formed at the right side.

Further, the feed roller and the retard roller may have the same shapes. In this case, the parallelism between the feed roller and the retard roller can be maintained more easily. In addition, since common parts are increased, control of parts can be facilitated and the production cost can be reduced.

The reverse rotation roller in the present invention also includes a reverse rotation roller (not shown) which is always rotated in the reverse direction, as well as a reversible roller such as the retard roller.

What is claimed is:

1. A sheet feeding apparatus comprising a pair of rotary drive shafts disposed in parallel with each other and rotated in the same direction, a sheet feed roller provided on one of said rotary drive shafts, and a reverse rotation roller provided on the other rotary drive shaft and urged against said sheet feed roller, wherein sheets are separated and fed one by one between said sheet feed roller and said reverse rotation roller, and wherein at least one of said sheet feed roller and said reverse rotation roller is provided with a through hole through which said rotary drive shaft passes, and said through hole has an intermediate portion through which said rotary drive shaft passes, and an escape portion provided at an end portion and adapted to permit inclination of said rotary drive shaft to maintain parallelism between said one roller and the other roller if said rotary drive shaft is inclined.

2. A sheet feeding apparatus according to claim 1, wherein said escape portion is constituted by selecting a diameter of said intermediate portion of said through hole to be greater than a diameter of said end portion.

3. A sheet feeding apparatus according to claim 2, wherein said escape portion is formed so that a diameter of said escape portion is gradually increased from said intermediate portion toward said end portion.

4. A sheet feeding apparatus according to claim 1, wherein said escape portion extends in a thrust direction from said intermediate portion toward a side end portion of said through hole and has a plurality of elastic pieces arranged in a circumferential direction.

5. A sheet feeding apparatus according to claim 4, wherein one of said elastic pieces is provided with a fall preventing engagement portion for preventing fall of said roller by engaging with an engaged portion formed in said rotary drive shaft.

6. A sheet feeding apparatus according to claim 5, wherein said engaged portion comprises a groove formed in an outer peripheral surface of said rotary drive shaft, and said fall preventing engagement portion comprises a projection formed on said elastic piece.

7. A sheet feeding apparatus according to claim 1, wherein said escape portions are provided on both ends of said through hole, and said escape portion provided on one end has a diameter gradually increasing from said intermediate portion toward said end portion, and said escape portion provided on the other end extends in a thrust direction from said intermediate portion toward a side end portion and has a plurality of elastic pieces arranged in a circumferential direction.

8. A sheet feeding apparatus according to claim 1, wherein said sheet feed roller and said reverse rotation roller comprise cylindrical collar portions to be mounted on said rotary drive shafts and friction members mounted on peripheral surfaces of said collar portions, and said escape portion is formed on said collar portion.

9. A sheet feeding apparatus according to claim 8, wherein said collars are molded from resin.

10. A sheet feeding apparatus according to claim 1, wherein said reverse rotation roller is engaged by a torque limiter secured to said rotary drive shaft so that said reverse rotation roller is rotated by rotation of said rotary drive shaft via said torque limiter.

11. An image forming apparatus comprising:

a sheet feeding apparatus including a pair of rotary drive shafts disposed in parallel with each other and rotated in the same direction, a sheet feed roller provided on one of said rotary drive shafts, and a reverse rotation roller provided on the other rotary drive shaft and urged against said sheet feed roller, wherein sheets are separated and fed one by one between said sheet feed roller and said reverse rotation roller; and an image forming means for forming an image on the sheet fed out by said sheet feeding apparatus;

wherein at least one of said sheet feed roller and said reverse rotation roller is provided with a through hole through which said rotary drive shaft passes, and said through hole has an intermediate portion through which said rotary drive shaft passes, and an escape portion provided at an end portion and adapted to permit inclination of said rotary drive shaft to maintain parallelism between said one roller and the other roller if said rotary drive shaft is inclined.

* * * * *

UNITED STATES PATENT AND TRADEMARK OFFICE

CERTIFICATE OF CORRECTION

PATENT NO. : 6,120,018

DATED : September 19, 2000

INVENTOR(S): MASAO AMANO

It is certified that error appears in the above-identified patent and that said Letters Patent is hereby corrected as shown below:

COVER PAGE AT ITEM [30]:
Foreign Application Priority Data: Insert --[30] Foreign Application Priority Data June 30, 1998 [JP] Japan 10-185276--.

COLUMN 1:
Line 52, "ends" should read --end--; and
Line 59, "ends" should read --end--.

COLUMN 3:
Line 59, "rollerst, 49" should read --rollers 8, 49.--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*